US005172670A

United States Patent [19]

Nemoto

[11] Patent Number: 5,172,670

[45] Date of Patent: Dec. 22, 1992

[54] CONTROL METHOD FOR AN INTERNAL COMBUSTION ENGINE AND ELECTRONIC CONTROL APPARATUS THEREFOR

[75] Inventor: Mamoru Nemoto, Katsuta, Japan

[73] Assignees: Hitachi, Ltd.; Hitachi Automotive Engineering Co., Ltd., both of Tokyo, Japan

[21] Appl. No.: 692,571

[22] Filed: Apr. 29, 1991

[30] Foreign Application Priority Data

May 11, 1990 [JP] Japan ..... 2-119850

[51] Int. Cl.[5] ..... F02P 5/00

[52] U.S. Cl. ..... 123/416; 364/431.05

[58] Field of Search ..... 123/416, 417, 418, 406, 123/478, 480, 414, 425, 571; 364/431.05, 431

[56] References Cited

U.S. PATENT DOCUMENTS 4,303,977 12/1981 Kobashi et al. ..... 364/431
4,328,779 5/1982 Hattori et al. ..... 123/416
4,503,822 3/1985 Kobayashi et al. ..... 123/416
4,524,745 6/1985 Tominari et al. ..... 123/478
4,527,526 7/1985 Akasu ..... 123/425
4,570,594 2/1986 Egami et al. ..... 123/414
4,814,997 3/1989 Matsumura et al. ..... 364/431.05
4,947,820 8/1990 Kushi ..... 123/571

*Primary Examiner*—Raymond A. Nelli
*Attorney, Agent, or Firm*—Ladas & Parry

[57] ABSTRACT

A method of controlling the operation of an internal combustion engine is performed by the steps of detecting operational conditions of the engine, and determining the required amount of fuel to be fed to each of the cylinders based upon the number of engine revolutions and the amount of intake air received before the fuel injection valve is opened. The method detects the actual amount of intake air in the suction stroke of a cylinder of concern after the fuel injection valve is opened and the ignition timing is controlled in dependence upon the actual amount of intake air. An electronic control apparatus for performing said method is also disclosed.

14 Claims, 12 Drawing Sheets

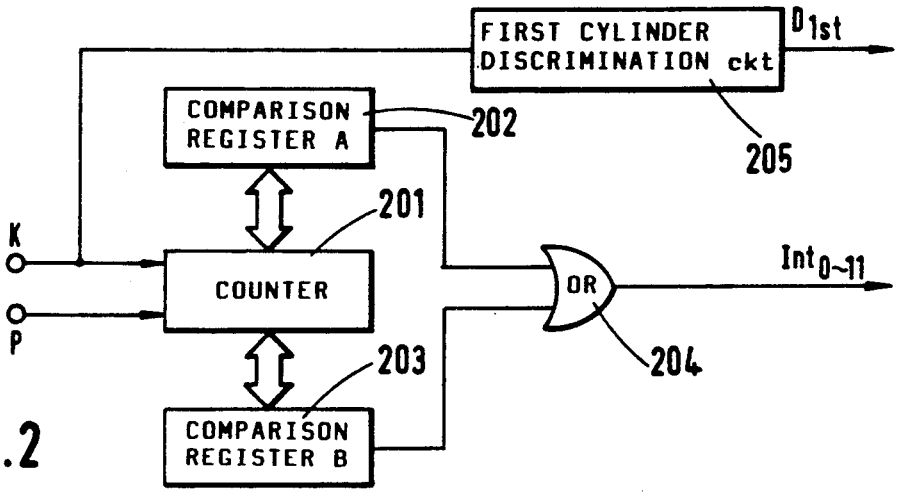
Fig.2
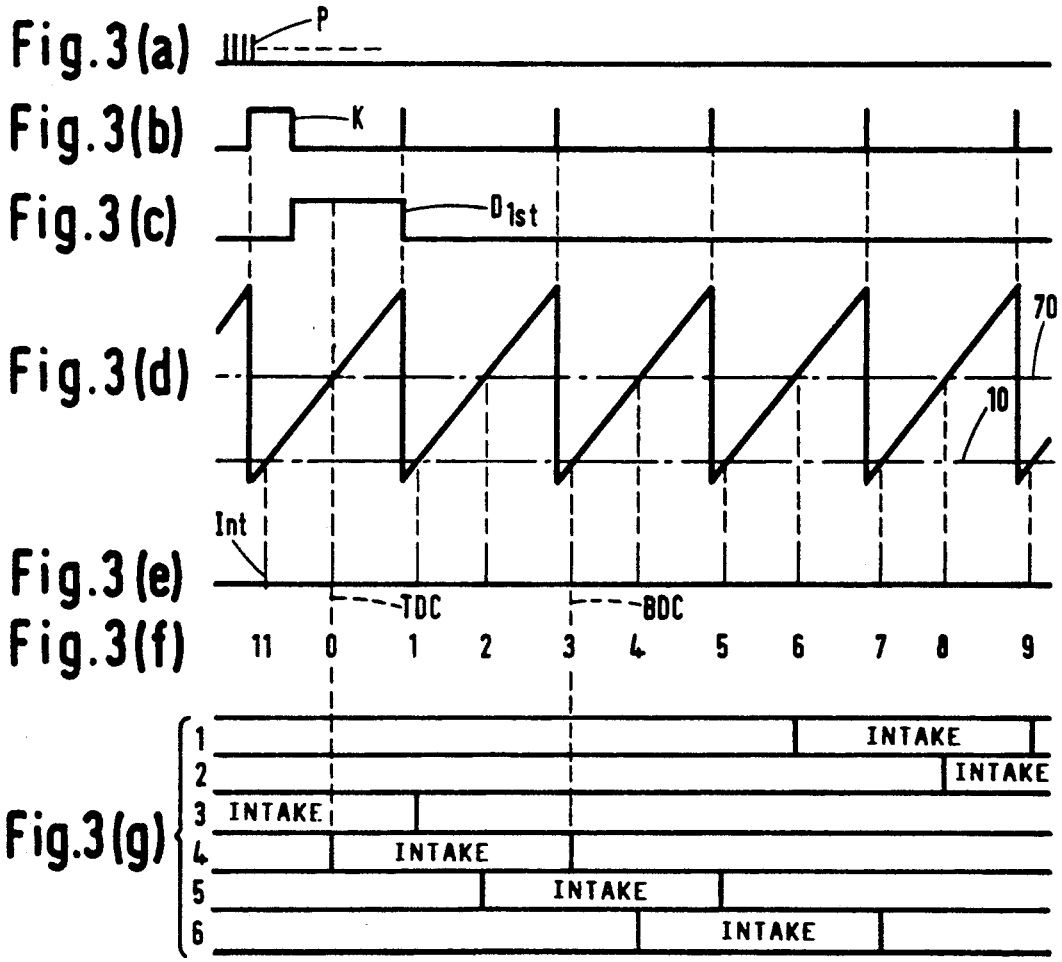

K

Int
5 6 7 8 9 10 11 0 1 2 3 4 5 6
FIRST CYLINDER

COMPRESSION
EXPLOSION
EXHAUST
INTAKE
EXHAUST
INJECTOR DRIVE PULSE GENERATION INTERRUPT
IGNITION SIGNAL

20
Qa (kg/h)
0

800
Ne (rpm)
600
A
B
ΔA/F
RICH
A/F 14.7
LEAN
A/F2
A/F1

CONTROL METHOD FOR AN INTERNAL COMBUSTION ENGINE AND ELECTRONIC CONTROL APPARATUS THEREFOR

BACKGROUND OF THE INVENTION

1. Field of the Invention

The present invention relates to a method of electronically controlling the operation of an internal combustion engine mounted, for example, in an automobile or the like, and to an electronic control apparatus for executing the method.

2. Description of the Related Art

A conventional widely applied method of controlling the operation of an internal combustion engine mounted on an automobile or the like consists of detecting various data that represent operation conditions of the internal combustion engine such as the number of revolutions, the amount of intake air, determining by calculation the amount of fuel to be fed to the internal combustion engine, ignition timing and the like by using an electronic control device such as a microcomputer, and controlling the fuel injection valve in accordance with the thus determined amount of fuel to be fed and controlling ignition timing of the ignition device. In such a method of controlling operation of the internal combustion engine, however, the data representative of the amount of intake air used for calculating the amount of fuel to be fed is data from the previous cycle. At the time of, for example, rapid acceleration, therefore, the amount of air actually sucked in the cylinder is different from the amount of intake air used for calculating the amount of fuel to be fed, and thereby the torque produced by the internal combustion engine undergoes a change which causes vibration and thus gives the driver an uncomfortable ride. This is due to the fact that, in general, a relatively small torque is produced when the air-fuel (A/F) ratio in the cylinders is lean and a large torque is produced when the A/F ratio is rich.

In order to accomplish optimum control of fuel supply during such a transient period, therefore, a fuel injection control device has been proposed as in, for example, Japanese Patent Laid-Open No. 261625/1987 in which the amount of fuel to be fed is determined by estimating the forementioned data immediately after the fuel injection valve is opened based upon the data inputted just before the fuel injection valve is opened.

In the fuel injection control apparatus of the above-mentioned prior art, the data just after the fuel injection valve is opened is estimated from the data just before the fuel injection valve is opened. In practice, however, this estimation is so difficult that there develops a difference from the amount of air actually sucked, making it difficult to exercise optimum A/F control. For example, it is very difficult to estimate the amount of intake air, particularly under the idling operation condition in which the number of engine revolutions tends to vary up and down a small amount. Under such a condition, the internal combustion engine tends to produce excessively large or small torque resulting in an increase in vibration.

In view of the above-mentioned problem inherent in the prior art, the object of the present invention is to provide a method of controlling operation of an internal combustion engine which does not cause variation in the torque even when the A/F ratio deviates from the optimum value in each of the cylinders of the internal combustion engine and which, therefore, is capable of smoothly producing torque with suppression of vibration, and to provide an electronic control apparatus therefor.

SUMMARY OF THE INVENTION

The above-mentioned object of the present invention is accomplished in a first aspect by a method of controlling the operation of an internal combustion engine, including the steps of detecting the amount of fuel fed to each cylinder in dependence upon the number of revolutions of the engine and the amount of intake air that is received before the fuel injection valve is opened, detecting the actual amount of intake air that is sucked into each cylinder of the engine after the fuel injection valve is opened and based thereupon controlling the engine ignition timing.

In a feature of said first aspect there is provided a method of controlling the operation of a multi-cylinder internal combustion engine including the steps of determining the required amount of fuel to be fed to each of the cylinders based at least upon (a) the number of revolutions of the internal combustion engine and (b) the amount of intake air, received before a fuel injection valve is opened, controlling said fuel injection valve to inject fuel to said engine in dependence upon said required amount of fuel that is determined, said method being characterised by detecting the actual amount of intake air in the suction stroke of a cylinder of concern after said fuel injection valve is opened, and controlling the ignition timing for said cylinder of concern based upon the actual amount of intake air.

In a second aspect of this invention there is provided an electronic fuel control apparatus for an internal combustion engine comprising means for determining the amount of fuel fed to a cylinder in dependence upon the number of revolutions of the engine and means for determining the amount of intake air that is received before a fuel injection valve is opened, means for detecting the actual amount of intake air that is sucked into said cylinder of the engine after the fuel injection valve is opened to produce a signal, and means using said signal for controlling the engine ignition timing for said cylinder.

In a feature of said second aspect there is provided an electronic control apparatus of an internal combustion engine which comprises detecting means for detecting various data that represent operation conditions of the internal combustion engine, control circuit means that receives a detection signal from said detecting means and outputs at least a fuel feed control output and an ignition timing control output, a fuel injection valve that injects fuel according to said fuel feed control output from said control circuit means, and an ignition device that generates a high voltage for ignition according to the ignition timing control output from said control circuit means; the electronic control device characterized in that said control circuit means determines the required amount of fuel to be fed to each of the cylinders based upon the number of revolutions of the internal combustion engine and the amount of intaken air received before the valve-opening timing of said fuel injection valve, and further detects the actual amount of intake air in the suction stroke of each of the cylinders after the valve-opening timing of said fuel injection valve, in order to control the ignition timing based upon the actual amount of intake air.

By the above-mentioned method of controlling operation of the internal combustion engine and by the electronic control apparatus therefor according to the present invention, there is detected not only the amount of intake air before the opening time of the fuel injection valve used for determining the required amount of fuel to be fed, but also the actual amount of intake air in the suction stroke after the opening time is detected. This makes it possible to know the amount of deviation from the optimum value of the A/F ratio of the mixture charged into the cylinders of the internal combustion engine. In general, there is a relationship between the ignition timing and the torque in each of the cylinders of the internal combustion engine; that is, a large torque is produced when the ignition timing is advanced and, on the other hand, a small torque is produced when the ignition timing is delayed. In the present invention where attention is given to this fact, the ignition timing is suitably controlled to suppress variation in the torque that stems from the deviation of the actual A/F ratio from the optimum value in each of the cylinders, thereby to smoothly produce the torque while suppressing the development of vibration.

BRIEF DESCRIPTION OF THE DRAWINGS

The invention will now be described, by way of example, with reference to the accompanying drawings in which:

FIG. 2 shows a circuit diagram of a portion for generating interrupt signals in the control apparatus of FIG. 1;

FIGS. 3(*a*) to 3(*g*) show waveforms at points of the apparatus for explaining the operation of the FIG. 2 portion for generating interrupt signals;

In the FIGS. like reference numerals denote like parts.

DESCRIPTION OF THE PREFERRED EMBODIMENT

Figure 1:
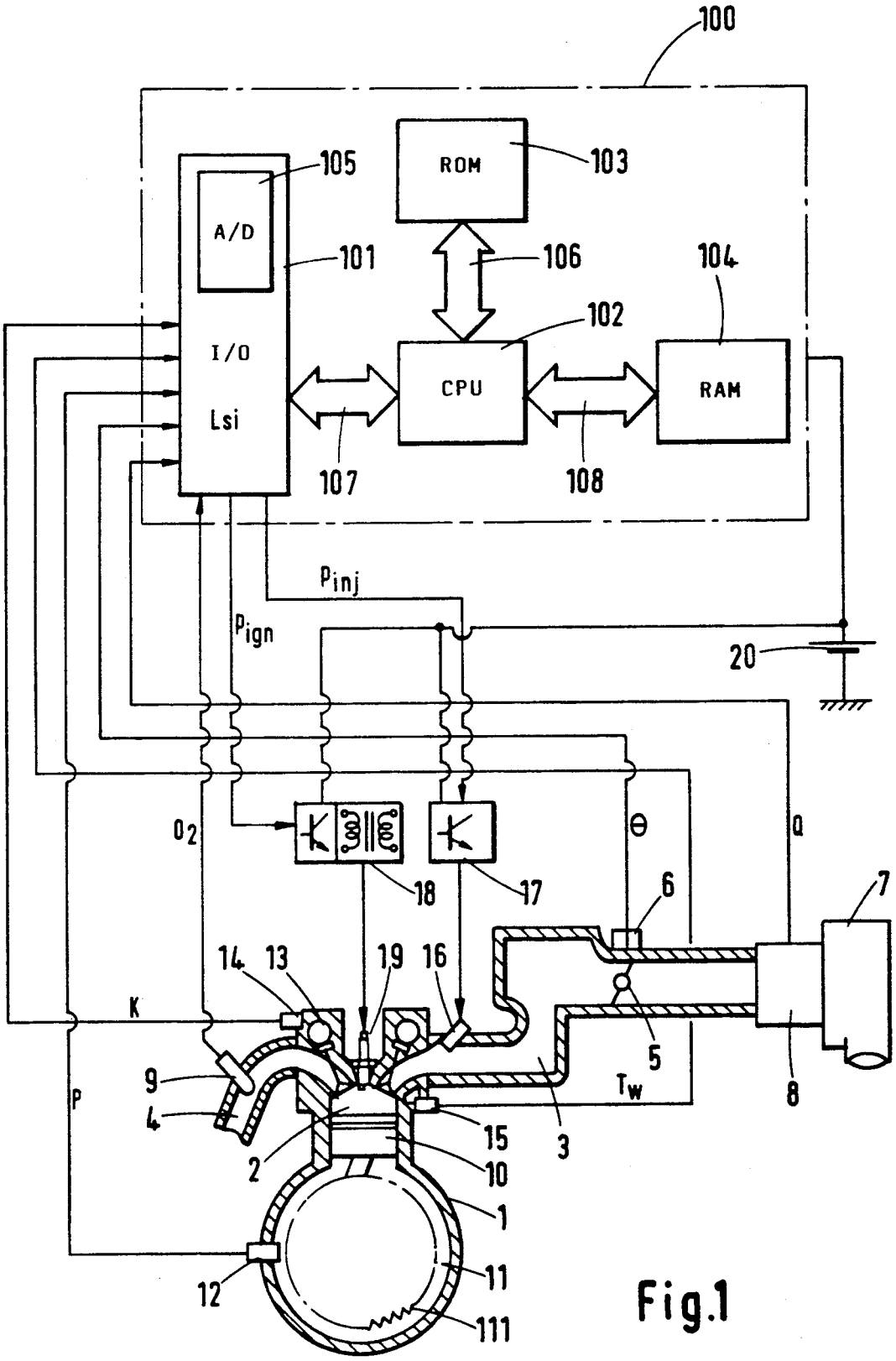
FIG. 1 shows a block schematic diagram of the whole structure of an electronic control apparatus in accordance with this invention.

FIG. 1 illustrates an internal combustion engine equipped with an electronic control apparatus for realizing the method of controlling operation of the internal combustion engine in accordance with the present invention. In FIG. 1, an internal combustion engine 1, for example, a six-cylinder engine mounted in an automobile, only one cylinder being shown in the FIG. 1, has an intake manifold 3 and an exhaust manifold 4 connected to the cylinders 2. A throttle valve 5 is provided on the upstream side of the intake manifold 3, and its opening angle determines the amount of intake air, the valve 5 being controlled in dependence upon the angle of an accelerator pedal (not shown). A throttle opening sensor 6 is mechanically coupled to the throttle valve 5, so that an electric signal $\theta$ is produced depending on the opening angle of the throttle valve 5.

On the upstream side of the throttle valve 5 is provided an air flow sensor 8 that is integrated with an air cleaner 7 thereby to measure the amount of intake air which is controlled by the throttle valve 5. The air flow sensor 8 for measuring the amount of intake air may be either a Karman vortex system, a mechanical damper system or a hot wire system. A so-called oxygen sensor 9 is provided at a portion of the exhaust manifold 4 to detect the density (for example, rich condition or lean condition) of the exhaust gas emitted from the cylinders 2 as binary data.

The reciprocating motion of pistons 10 of the internal combustion engine 1 is changed to rotary motion by a crankshaft (not shown) to rotate a fly-wheel 11. Along the circumference of the fly-wheel 11 is formed a gear 111 which meshes with a pinion of a starter motor (not shown), and a position sensor 12 is provided on the outside of the gear 111 of the fly-wheel 11 to detect the rotational angle of the internal combustion engine 1. The position sensor 12 is formed, for example, by an electromagnetic pickup, or the like, and generates a position pulse signal P every time a tooth of the gear 111 passes the sensor. Further, a camshaft mechanism 13 the rotation of which is related to the rotation of the crankshaft is provided with a reference position sensor 14 which generates a reference position pulse signal K that represents a specific crank position as hereinafter described. The sensor 14 may also be formed by, for example, an electromagnetic pickup or the like. In the cylinder wall of the internal combustion engine 1 is provided a water-temperature sensor 15 that detects the temperature of the cooling water and generates a temperature signal $T_w$.

Various outputs $\theta$, Q, $Q_2$, P, K and $T_w$ from the aforementioned various sensors, for example, from the throttle opening sensor 6, air flow sensor 8, oxygen sensor 9, position sensor 12, reference position sensor 14 and water temperature sensor 15, are input to a control circuit unit 100 as data for representing the operation condition of the internal combustion engine. As shown in the FIG. the control circuit unit 100 is formed, for example, by a microcomputer and is equipped with an input/output integrated circuit (I/O LSi) 101 which receives the outputs from the above-mentioned various sensors and generates control output signals that will be described later herein, a central processing unit (CPU) 102 that executes the operation, a read-only memory (ROM) 103 that stores a variety of execution programs and data, and a random access memory (RAM) 104 which temporarily stores various data necessary for the calculation. Moreover, the above I/O LSi 101 includes an A/D converter 105 that converts analog signals into digital signals, and is electrically connected to the CPU 102, ROM 103 and RAM 104 via data buses 106, 107, 108.

Control outputs from the above I/O LSi 101 include, for example, a fuel feed control signal Pinj that controls the amount of fuel fed to the internal combustion engine and an ignition timing control signal Pign that controls the ignition timing. More particularly, the fuel feed control signal Pinj controls the opening of the fuel injection valve (injector) 16 mounted on the tubular wall of the intake manifold 3 for each of the cylinders of the internal combustion engine 1; for instance, a drive pulse is fed to an electromagnetic coil (not shown) of the injector 16 via a driver circuit 17 which includes a transistor. The ignition timing control signal Pign is input to an ignition device 18 which generates a high voltage for ignition by intermittently flowing a primary current to the ignition coil. The high voltage for ignition is electrically connected to an ignition plug 19 provided in each of the cylinders 2 of the internal combustion engine 1, and thereby a spark is generated to ignite and explode the mixture charged in the respective cylinder 2. A storage battery 20 is mounted on the automobile to supply the required electric power to the driver circuit 17, ignition device 18, control circuit unit 100, and to the various sensors.

In the above-mentioned apparatus, the air sucked in the internal combustion engine 1 is controlled by the throttle valve 5, and the amount Q of intake air is detected by the air flow sensor 8. The number of revolutions of the internal combustion engine 1 is found by deriving an angular change per unit time from a signal P generated for every degree by utilizing the teeth of the gear 111 of the fly-wheel 11. Further, the temperature Tw of the cooling water that indicates the condition of the internal combustion engine 1 is detected by the water-temperature sensor 15, and the opening angle $\theta$ of the throttle valve 5 is detected by the throttle opening sensor 6. The control circuit 100 determines the amount of fuel to be injected and the ignition timing based upon the data that are detected by these various sensors and that represent the operation condition of the internal combustion engine. That is, the driver circuit 17 and the ignition device 18 are driven by the fuel feed control signal Pinj and the ignition timing control signal Pign output from the unit 100, and thereby the injector 16 is opened and the ignition spark plug 19 is ignited.

Next, described below in detail with reference to accompanying FIG. 2 is a circuit on the LSI 101 that generates a signal which represents the suction stroke, for example, generates a so-called intake cylinder reference signal for each of the cylinders of the internal combustion engine used in the control apparatus of the present invention. As shown in FIG. 2, the circuit for generating the intake cylinder reference signal is formed by a counter 201 which receives the position pulse signal P from the position sensor 12 that detects the revolution of the internal combustion engine 1 and the reference position pulse signal K output from the reference position sensor 14, two comparison registers A(202) and B(203), an OR circuit 204, and a first cylinder discrimination circuit 205.

Operation of the thus constituted circuit for generating intake cylinder reference, interrupt, signals will now be described with reference to FIGS. 3(*a*) to 3(*f*) that show waveforms at different points of the apparatus. As shown in FIG. 3(*a*), first, the position pulse signal P which is an output from the position sensor 12 repeats on and off (high and low) for every degree of crankshaft rotation. Referring to FIG. 3(*b*), on the other hand, the reference position pulse signal K which is an output from the reference position sensor 14 is generated for each cylinder of the internal combustion engine 1, for example, every 120 degrees for the six cylinders of this embodiment. These signals are adjusted to be generated 70 degrees before the compression top dead center (TDC) of each cylinder, and the pulse signal (extreme left in FIG. 3(*b*)) for the first cylinder has a width greater than the width of pulse signals for other cylinders. That is, checking the pulse width of the reference position pulse signal K at all times makes it possible to discriminate the first cylinder of the internal combustion engine. The first cylinder discrimination circuit 205 checks the reference position pulse signal K at all times, and is turned on at the fall of the first cylinder signal (wide signal) among the reference position pulse signals K, and is turned off by the next pulse, thereby to generate a first cylinder discrimination signal $D_{1st}$ on its output terminal as shown in FIG. 3(*c*).

The counter 201, on the other hand, is so designed that at the rise of the reference position pulse signal K it counts up the position pulse signals P. FIG. 3(*d*) shows count value of the counter 201. The count value (FIG. 3(*d*)) of the counter 201 is sent to the two comparison registers 202 and 203. Between these comparison registers, the comparison register A(202) is for discriminating the top dead center of each of the cylinders, and a numerical value of, for example, "70" is set, since the reference position pulse signal K has been set to a position 70 degrees before the top dead center (TDC). That is, since the position pulse P is output for every degree of rotational angle, the seventieth pulse signal P from the above signal K represents the top dead center.

The comparison register B(203), on the other hand, is for discriminating the bottom dead center (BDC) of each of the cylinders, and a numerical value "10" is set, since the reference position pulse signal K (FIG. 3(*b*)) in the present example is adjusted at 10 degrees before the bottom dead center.

The comparison registers A(202) and B(203) generate outputs when the count value of the counter 201 coincides with the set point value (70 or 10), and generate interrupt signals Int according to the top dead center (TDC) and bottom dead center (BDC) of each of the cylinders via an OR circuit 204 as shown in FIG. 3(*e*) where TDC and BDC for cylinder number 4 are shown.

As for discriminating the corresponding cylinders, the control circuit unit 100 counts up the corresponding contents of the corresponding RAM 104 for every interrupt signal Int, and allocates numerals 0 through 11 for the interrupt signals Int. That is, as shown in FIG. 3(*f*), the interrupt signal Int is set to be "0" at the time when the first cylinder discrimination signal $D_{1st}$ which is an output from the first cylinder discrimination circuit 205 is in the ON state, and is counted up thereafter for every interrupt signal Int.

As shown in FIG. 3(*g*), the interrupt signal Int thus generated represents the suction stroke of a cylinder of the internal combustion engine 1 in correspondence with the allocated number. The following Table 1 shows relationships between the numbers of the interrupt signals Int and the suction strokes of the cylinders.

TABLE 1

| Cylinder No. | Start of suction stroke | End of suction stroke |
|---|---|---|
| 1 | 6 | 9 |
| 2 | 8 | 11 |
| 3 | 10 | 1 |
| 4 | 0 | 3 |
| 5 | 2 | 5 |
| 6 | 4 | 7 |

With the above Table being stored in advance in the ROM 103, the control circuit unit 100 is allowed to easily discriminate the suction strokes of the cylinders.

Figure 4:
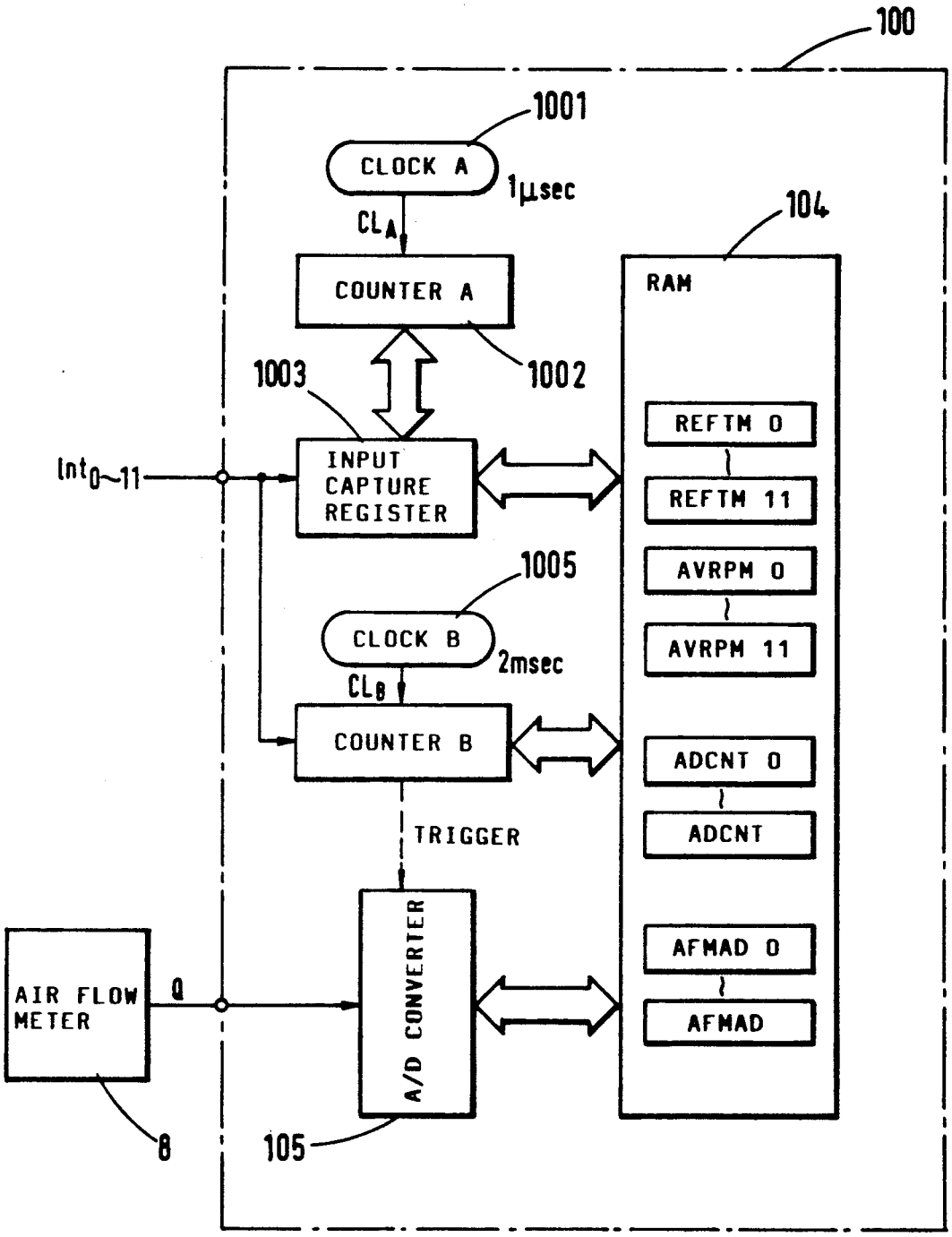
FIG. 4 shows a functional block diagram for explaining the detect operation of the control apparatus.

FIG. 4 shows in block form the construction for determining the average number N of revolutions of the internal combustion engine and the average quantity Q of intake air in the suction strokes of the cylinders of the internal combustion engine 1, as required by the present invention. FIG. 4 shows the functions executed by the CPU 102 in the control circuit unit 100, and in FIG. 4 a counter A 1001 receives and counts up a clock pulse $CL_A$ of 1μ sec generated by a clock A 1002. In response to the timing of generation of the interrupt signal Int shown in FIGS. 2 and 3(*e*), the count value of the counter A is transferred to an input capture register 1003 and is further stored in the RAM 104. At this moment, as shown, the data transferred from the input capture register 1003 to the RAM 104 is transferred to areas REFTM0 to REFTM11 that correspond to the numbers (0 to 11) of the interrupt signals Int. For instance, the data is stored in REFTM0 when Int0 is tenerated and is stored in REFTM11 when Int11 is generated.

Using the data REFTM0 to REFTM11, the CPU 102 determines an average number of revolutions AVRPM that corresponds to the suction strokes of the cylinders in a manner described hereinbelow. For instance, as will be obvious from FIG. 3(*g*), the average number of revolutions AVRPM4 corresponding to the suction stroke of the fourth cylinder is found in compliance with the following equation, $$\text{AVRPM4 (rpm)} = (60 \times 10^3 \times 10^3)/[2 \times (\text{REFTM3} - \text{REFTMO})].$$

In the same manner hereinafter, AVRPM1 to AVRPM6 are found and are stored in respective portions AVRPM0 to AVRPM11 of the RAM 104.

To determine the average amount of intake air for each of the respective cylinders, i.e. a cylinder of concern, a clock pulse $CL_B$ of about 2 msec generated by the clock B 1004 is counted up by the counter B 1005, and an analog signal of the air flow meter 8 is converted into a digital signal by an A/D converter 105 at each clock pulse. The counter B 1005 is reset by the interrupt signal Int. The thus converted digital signals are added at each interrupt signal Int to the corresponding areas AFMAD0 to AFMAD11 in the RAM 104 corresponding to the numbers (0 to 11) of the interrupt signals Int. The number of times A/D conversion occurs is determined by the interrupt signals Int coinciding with the count value of the counter B 1005, and the converted signals are stored in the areas ADCNT0 to ADCNT11 in the RAM 104 corresponding to the numbers (0 to 11) of the interrupt signals Int.

The average amount AFMQ of intake air is found by using the above-mentioned data AFMAD and ADCN; for example, the average amount AFMQA4 of intake air in the fourth cylinder is found, referring to FIG. 3(*g*), in compliance with the following equation, $$\text{AFMQA4} = (\text{AFMAD0} + \text{AFMAD1} + \text{AFMAD2}) / (\text{ADCNT0} + \text{ADCNT1} + \text{ADCNT2})$$

Figure 5:
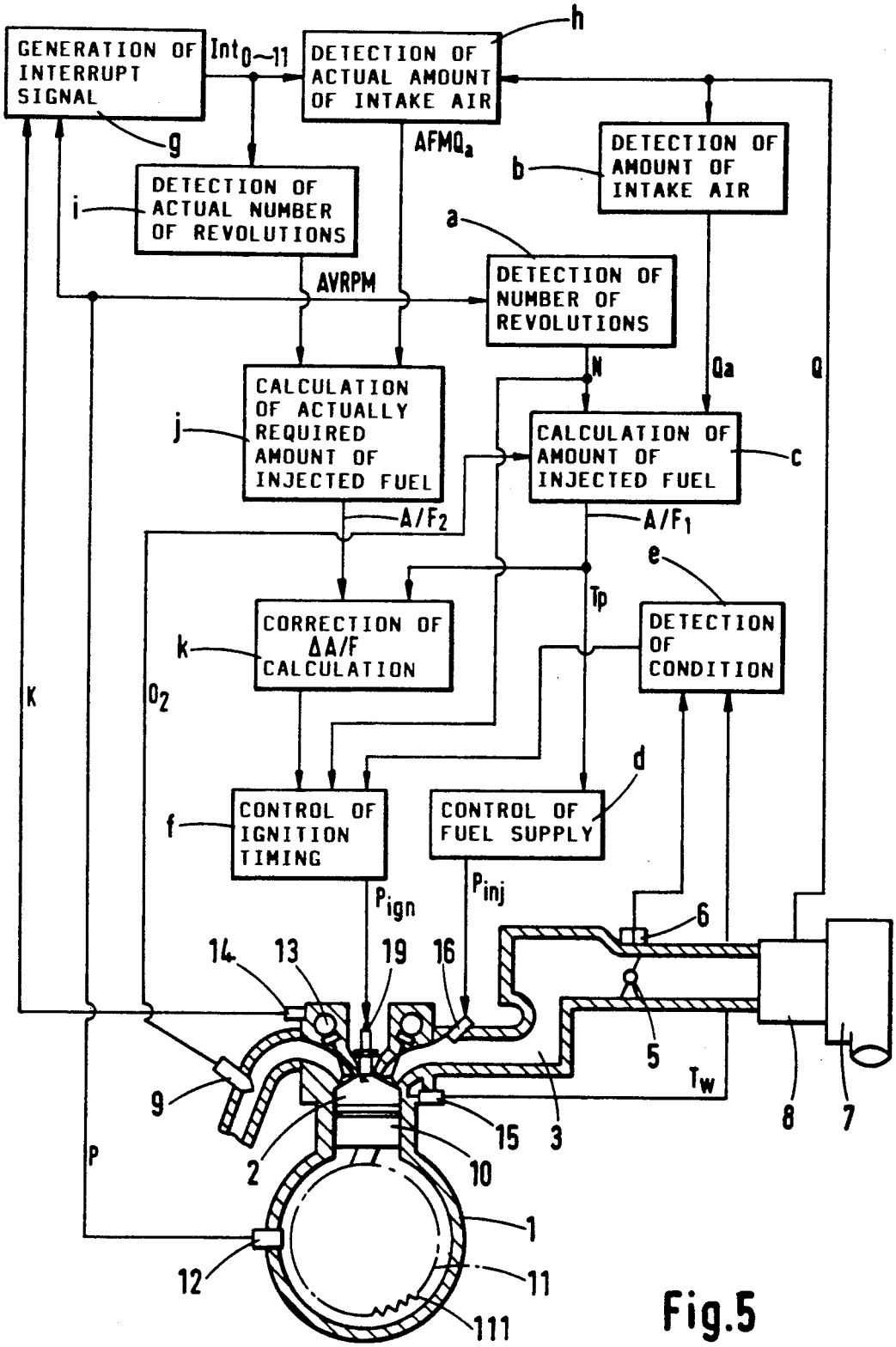
FIG. 5 shows a functional block diagram for explaining the operation of the electronic control apparatus shown in FIG. 1.

Operation of the above-mentioned electronic control apparatus will now be described in detail with reference to FIG. 5 which schematically shows the apparatus functions and FIG. 6 which shows waveforms at different points in the apparatus. The schematic diagram of the functions in FIG. 5 shows in blocks the functions of the control circuit unit 100 based on the construction of the electronic control apparatus shown in FIG. 1.

First, in order to improve response characteristics during the acceleration and deceleration, the amount of fuel to be injected is ordinarily calculated as follows: position pulse signals P produced for every degree of rotational angle are sampled for a predetermined period of time, in order to find the number N of revolutions (number-of-revolutions detecting block a). Next, the amount Qa of intake air is found by sampling the output signals Q from the air flow meter 8 for a predetermined period of time (amount-of-intake-air detecting block b). Then, based on the thus detected number of revolutions and amount of intake air, the fuel injection pulse width Tp is calculated (amount-of-fuel-injection calculation block c) for every predetermined time interval while feeding back the $O_2$ signals of the oxygen sensor 9, as in a conventional manner. Then, in compliance with the thus calculated fuel injection pulse width Tp, a pulse signal Pinj for driving the fuel injection valve 16 is generated for timing fuel injection (fuel feed control d) thereby to feed the above calculated amount of fuel to the internal combustion engine 1.

Figure 7:
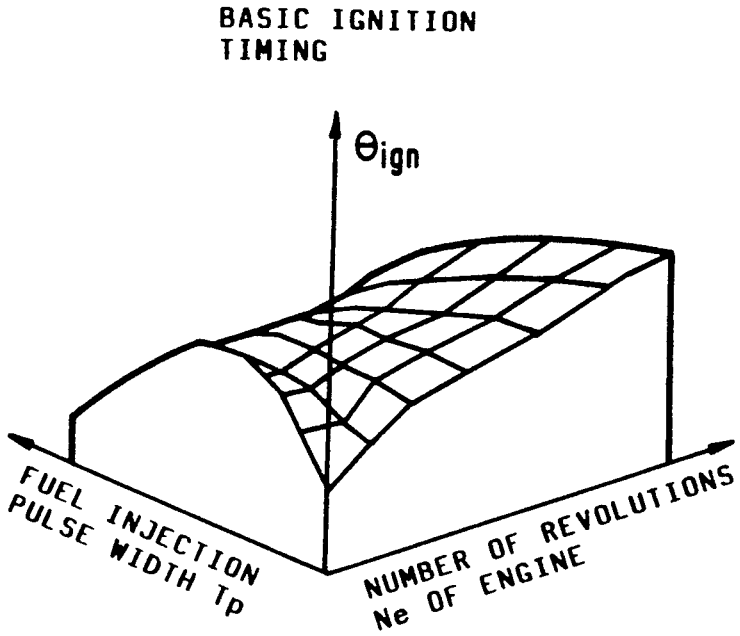
FIG. 7 shows in graphical form a map of basic ignition timings used in the control apparatus.

In calculating the ordinary ignition timing, a basic ignition timing θign is found from the map of basic ignition timing shown in FIG. 7 based on the fuel injection pulse width Tp found in the amount-of-fuel-injection calculation block c and the number N of revolutions found in the number-of-revolutions detect block a. The basic ignition timing is then corrected by a detect signal (from condition detection block e) representing the condition of the internal combustion engine such as temperature Tw of the cooling water, in order to generate a pulse signal Pign (ignition-timing control block f) to drive the ignition device, as in the customary manner.

However, in the present invention, the following functions are provided in addition to the operation functions described above.

That is, as shown in FIGS. 2 and 3, the interrupt signals $Int_{0-11}$ are generated (interrupt signal block g) that correspond to the suction strokes of the cylinders of the internal combustion engine using position pulse signal P and reference position pulse signal K, and the amount of intake air actually sucked into the cylinder in the suction stroke of each of the cylinders and the actual number of revolutions during that period are found using the above interrupt signals Int (amount-of-intake-air detect block h, actual-number-of-revolutions detect block i). As also shown in FIG. 4, the actual amount of intake air and the actual number of revolutions are found from AFMAD 0–11 as an average amount $AFMQ_a$ of intake air and an average number AVRPM of revolutions in the suction stroke of each of the cylinders from AVRPM 0–11. Then based upon this data, the amount of fuel to be injected actually required by each of the cylinders is calculated (actually-required-amount-of-injected fuel calculation block j). Next, the thus calculated actually required amount of fuel to be injected is compared with the fuel injection pulse width Tp that represents the amount of fuel that has been calculated and injected, thereby to find a deviation ΔA/F of the air-fuel ratio A/F in the cylinder and to correct the basic ignition timing θign using ΔA/F (ΔA/F calculation correction block k).

The above operation will now be described in conjunction with FIG. 6 which shows the operation of, for example, the first cylinder of the six-cylinder internal combustion engine. FIG. 6(*a*) shows reference position pulse signals K, FIG. 6(*b*) shows interrupt signals Int, and FIG. 6(*c*) shows strokes (exhaust, intake, compression, explosion) of the first cylinder. FIG. 6(*d*) shows an injector drive pulse generation interrupt signal for calculating the ordinary amount of fuel to be injected. At the moment when this interrupt signal is generated, the fuel injection pulse width Tp is determined by calculating the amount of fuel to be injected based on the amount Qa of intake air (FIG. 6(*e*)) and the number Ne of revolutions of the internal combustion engine (FIG. 6(*f*)) that are input at a timing Ⓐ which is earlier than the time when the above interrupt signal is generated.

Figures 6A, 6B, 6C, 6D, 6E, 6F, 6G:
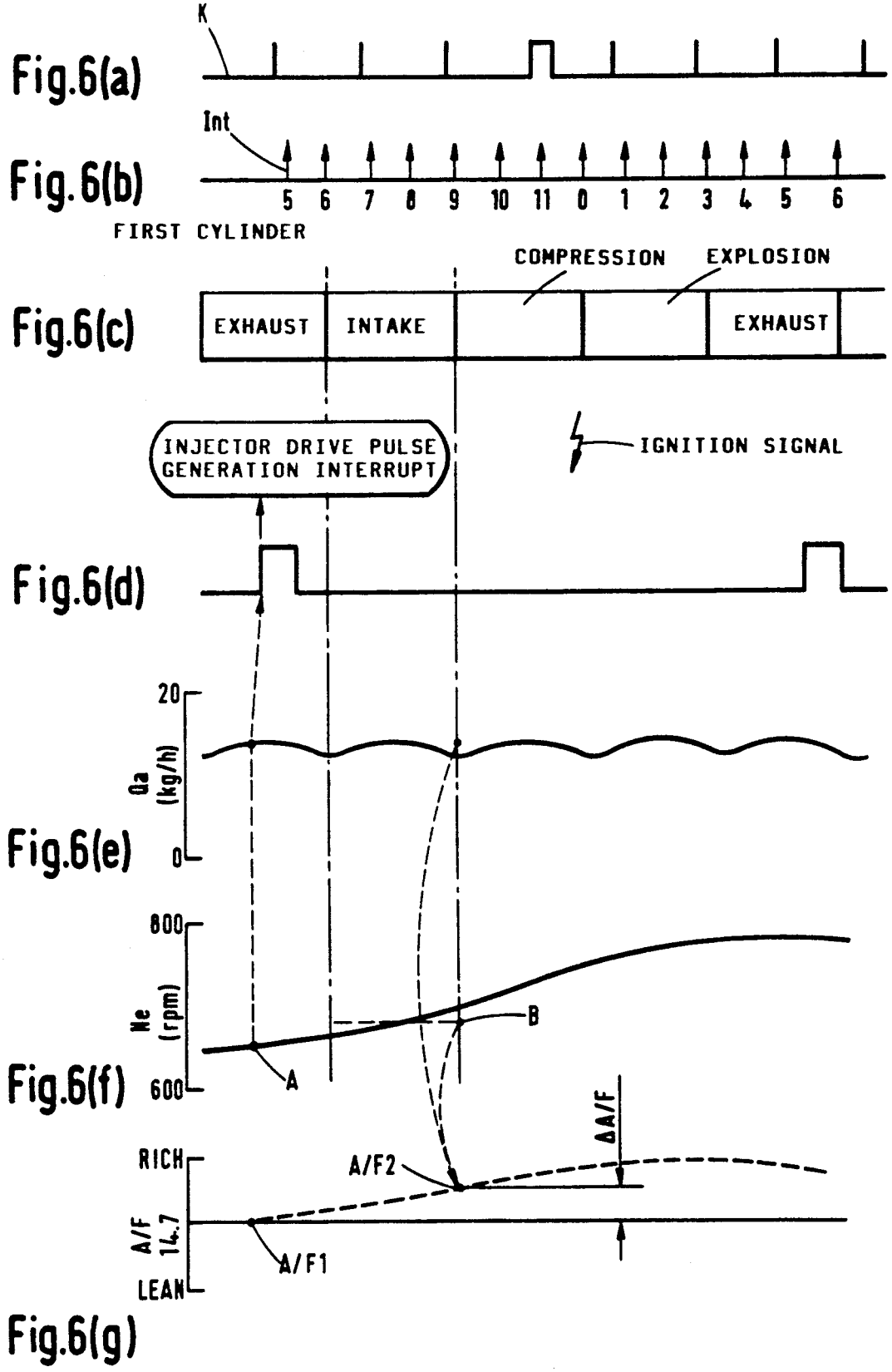
FIGS. 6(*a*) to 6(*g*) shows a diagram of waveforms at each of the points of the apparatus for explaining the detect operation of FIG. 5.

Here, in the actual Operation of the internal combustion engine as shown in FIGS. 6(*e*) and 6(*f*), these values Qa and Ne undergo a change particularly during the time of acceleration and deceleration or during the idling operation. Therefore, the values Qa and Ne at the above timing Ⓐ are different from those in the subsequent suction stroke. In the present invention, therefore, the amount of air actually sucked in the suction stroke of the first cylinder (for example, average amount $AFMQ_a$ of intake air in the suction stroke of the first cylinder) and the actual number of revolutions (for example, average number AVRPM of revolutions) are found by the blocks h and i of FIG. 5, and the actual A/F (A/F2) ratio in the first cylinder is calculated based thereupon and is compared with the previously calculated air-fuel ratio A/F (A/F1) that has been used for calculating the amount of fuel to be injected, thereby to find the difference ΔA/F therebetween at timing Ⓑ.

Figure 11A:
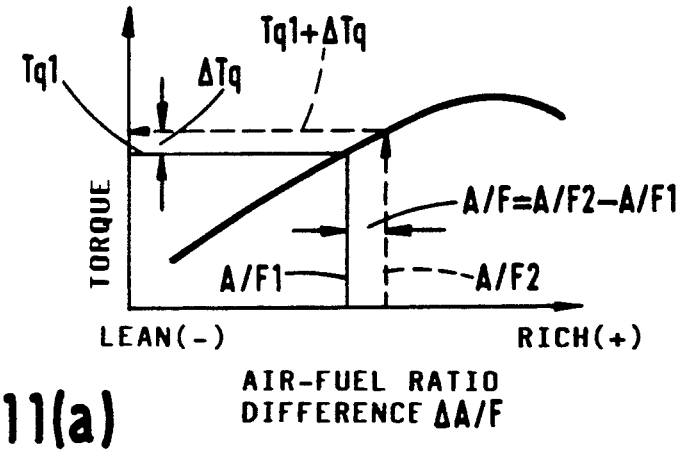
FIGS. 11(*a*) and 11(*b*) show graphs of the contents of the map of FIG. 7 for correcting the ignition timing.
Figure 11B:
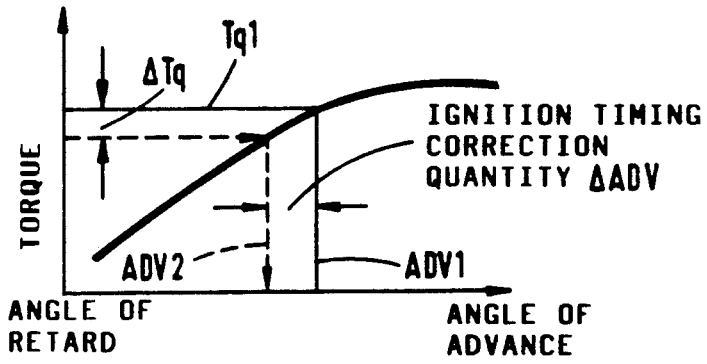

Using the thus found difference ΔA/F, the ignition timing is controlled more suitably in order to render more uniform the torque produced by the cylinders and to obtain smooth operation (FIG. 6(*g*)—a richer mixture producing increased torque as shown in FIG. 11).

Figure 8:
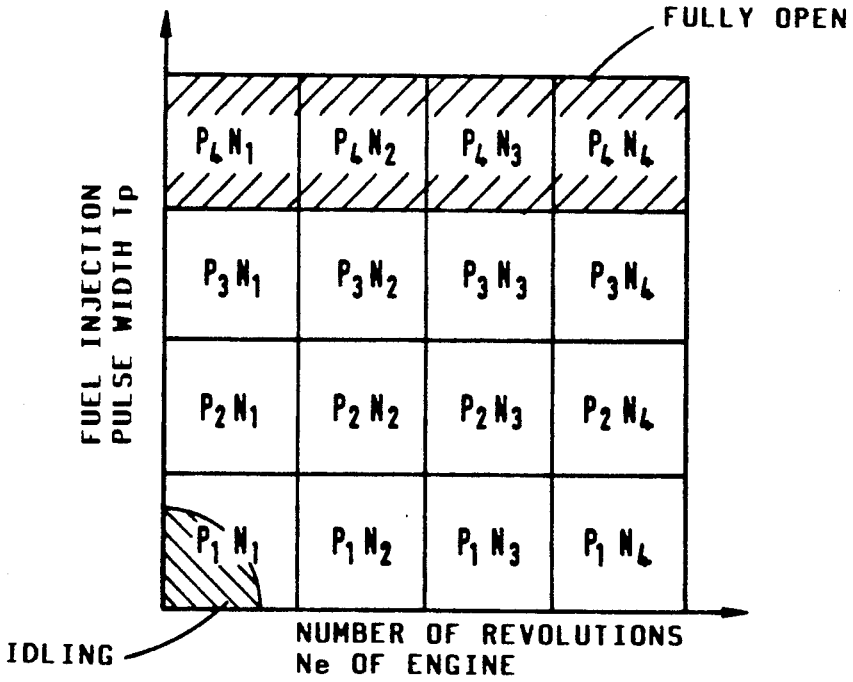
FIG. 8 shows a diagram of a map for correcting the ignition timing divided into a plurality of regions, that is used in the control apparatus.

FIG. 8 shows an ignition timing correction map for finding a correction quantity for the map of basic ignition timings shown in FIG. 7. The ignition timing correction map is divided, as shown, into a plurality of regions by the number Ne of revolutions and by the fuel injection pulse width Tp, for example, divided into regions $P_1N_1$ to $P_4N_4$ (16 regions).

Figure 9:
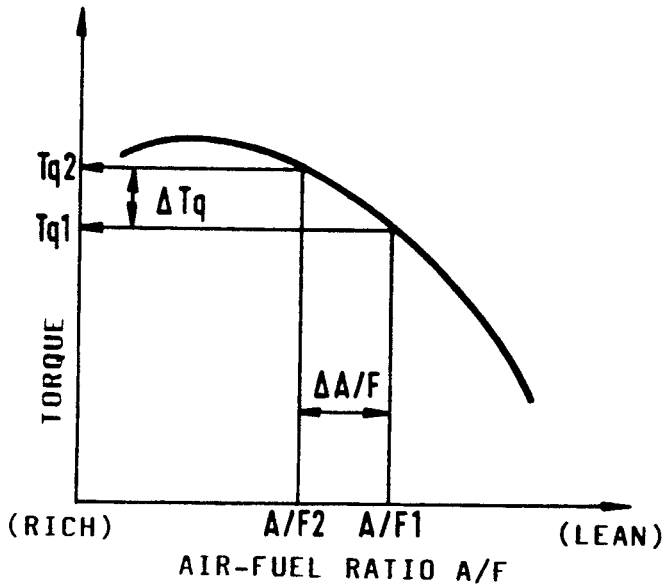
FIGS. 9 and 10 show graphs of the relationships between the air-fuel ratio, torque and ignition timing, on which the present invention is based.
Figure 10:
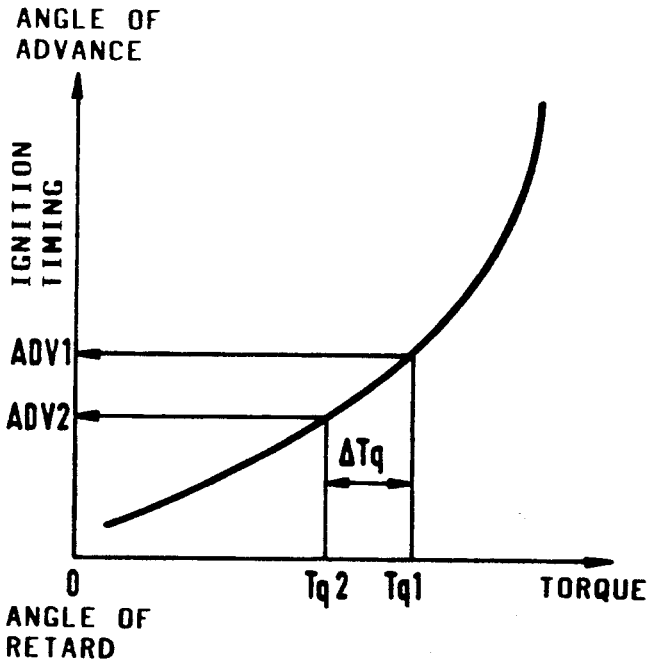

In general, the relationship between the air-fuel ratio A/F of fuel charged into the cylinder and the generated torque and the relationship between the generated torque and the ignition timing are shown in FIGS. 9 and For instance, if now the amount of air actually sucked in the suction stroke of the first cylinder changes and the actual air-fuel ratio A/F2 becomes richer than the desired air-fuel ratio A/F1, the torque that is produced changes from $Tq_1$ to $Tq_2$, that is, increases by $\Delta Tq = Tq_2 - Tq_1$ (FIG. 9). In order to cancel the change in the torque caused by deviation in the actual air-fuel ratio A/F and to obtain smooth torque, the ignition timing, in the present invention, is delayed as shown in FIG. 10 in an attempt to decrease the torque $Tq_1$ that would be produced when the air-fuel ratio A/F is A/F1. That is, the ignition timing (expressed here as ADV) ADV1 used to determine the amount of fuel injection is delayed by an amount enough for decreasing the torque by ΔTq. In effect, ADV1 is corrected to be ADV2.

FIGS. il(*a*) and ii(*b*) show the contents of the regions ($P_1N_1$ to $P_4N_4$) of the ignition timing correction map (FIG. 8) for correcting the aforementioned ignition timing. As will be obvious from these drawings, the amount of change ΔTq in the torque is found from the difference (ΔA/F=A/F2−A/F1) between the desired air-fuel ratio A/F1 that has been determined and the actual air-fuel ratio A/F2. In the FIG. 11(*a*) example, the actual air-fuel ratio A/F2 is richer by ΔA/F and the torque that is produced is greater by ΔTq than the torque $Tq_1$ that must be produced. By utilizing the relationship of FIG. 11(*b*), therefore, an ignition timing correction quantity ΔADV is found that is necessary for decreasing the produced torque by ΔTq. These relationships are stored in advance in the ROM 103 and can be easily obtained by map retrieval.

In the aforementioned embodiment relating generally to steady state conditions, the ignition timing is determined by, first, finding a basic ignition timing ADV which is then corrected by an ignition timing correction quantity ΔADV that is found subsequently. In the present invention, during transient conditions of accelerating or decelerating, the actual air-fuel ratio A/F2 is found without finding the basic ignition timing ADV, and the ignition timing is determined based on the actual air-fuel ratio A/F2. Such control is carried out when, for example, the amount of change in the opening angle of the throttle valve 5 is smaller than a predetermined value, that is, when the driver expects a constant torque, or when the fuel injection pulse width is smaller than a predetermined value, that is, when the torque produced by the internal combustion engine must be maintained constant.

Figure 12:
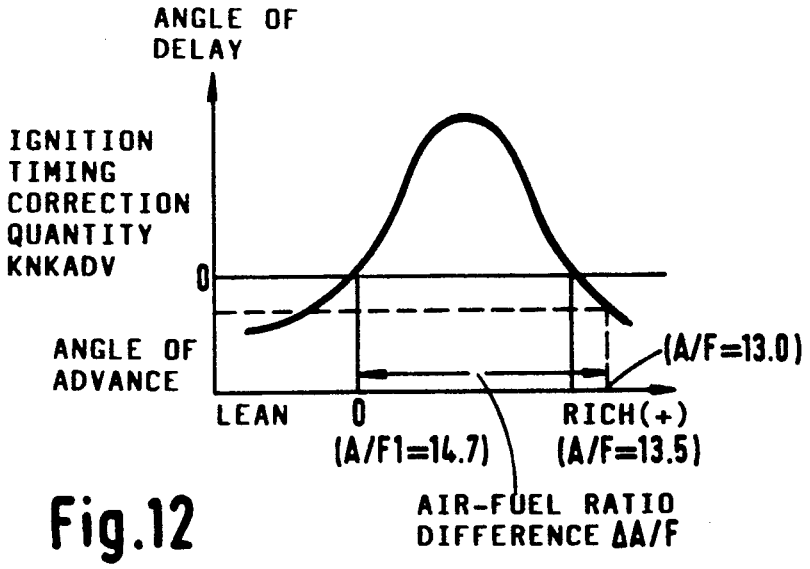
FIG. 12 shows a graph of the contents of a map for retrieving the ignition timing correction quantity of knocking used in the present invention.

When the amount of change in the opening angle of the throttle valve 5 is greater than a predetermined value such as during acceleration or deceleration, knocking is likely to take place and a control operation must be carried out to prevent knocking. That is, knocking is liable to take place over a region where the air-fuel ratio A/F ranges from 14.7 to 13.5. In the present invention, the desired air-fuel ratio A/F is controlled to be 13.0 in order to increase the torque that is produced at the time of, for example, acceleration. In practice, however, the air-fuel ratio A/F enters the above-mentioned knocking region during acceleration or deceleration. In such a case, knocking can be prevented from developing and smooth output can be obtained by correcting the ignition timing based on the deviation between the actual A/F ratio and the desired A/F ratio, shown in FIG. 12 as the abscissa and wherein the ordinate represents the ignition timing correction quantity KNKADV for correcting the basic ignition timing.

Figure 13:
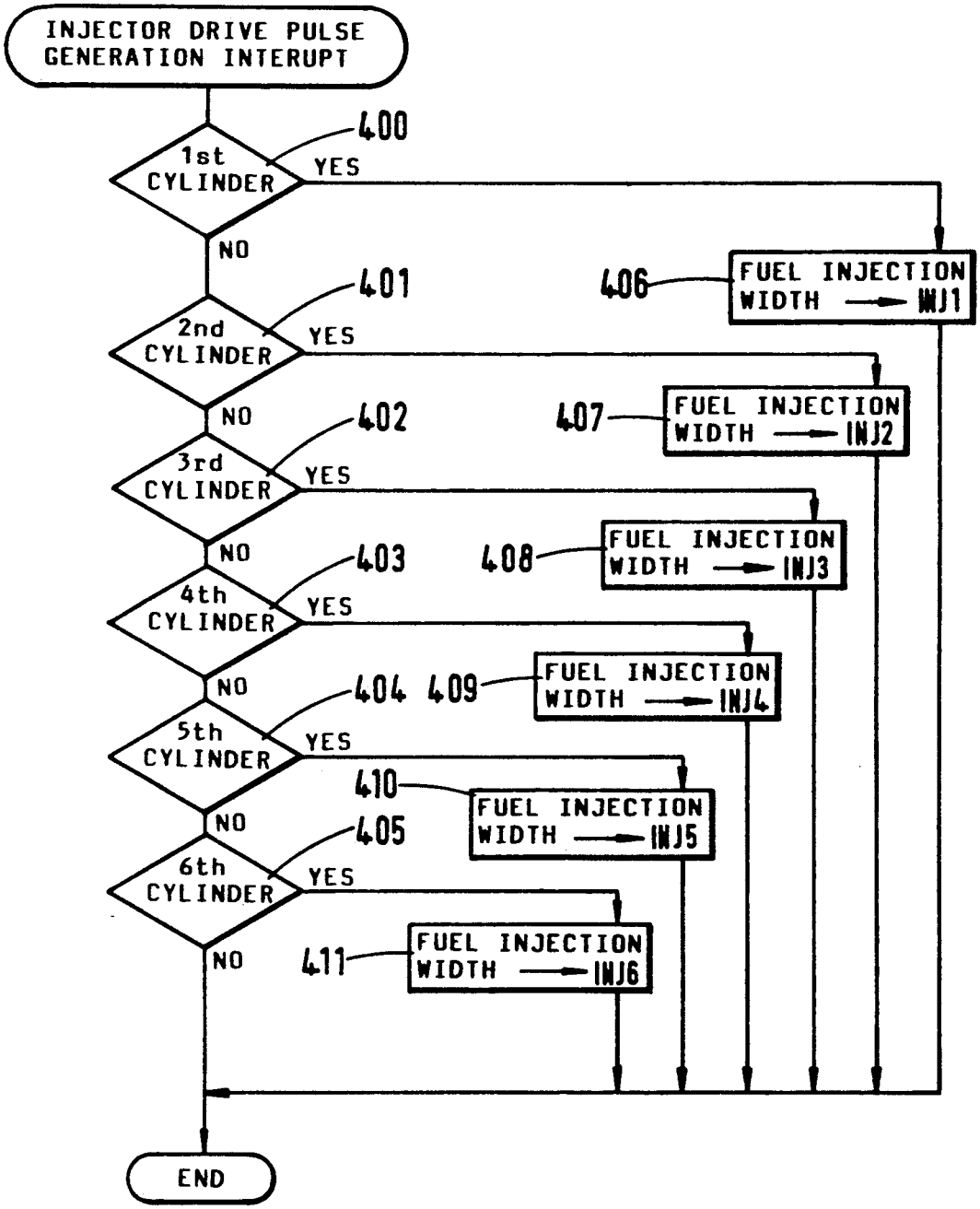
FIGS. 13 to 15 show flowcharts illustrating routines executed in the control apparatus of this invention.
Figure 14:
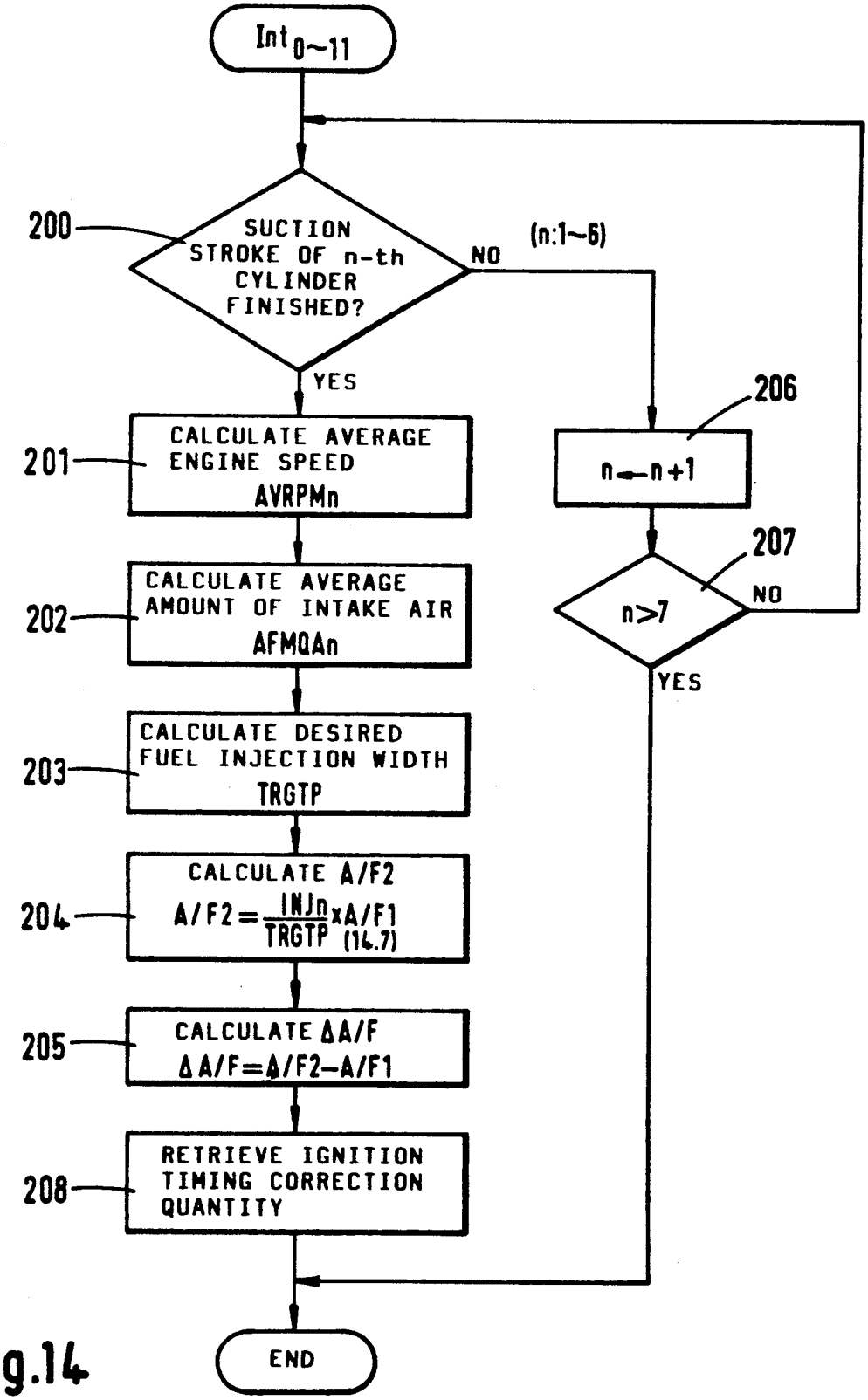
Figure 15:
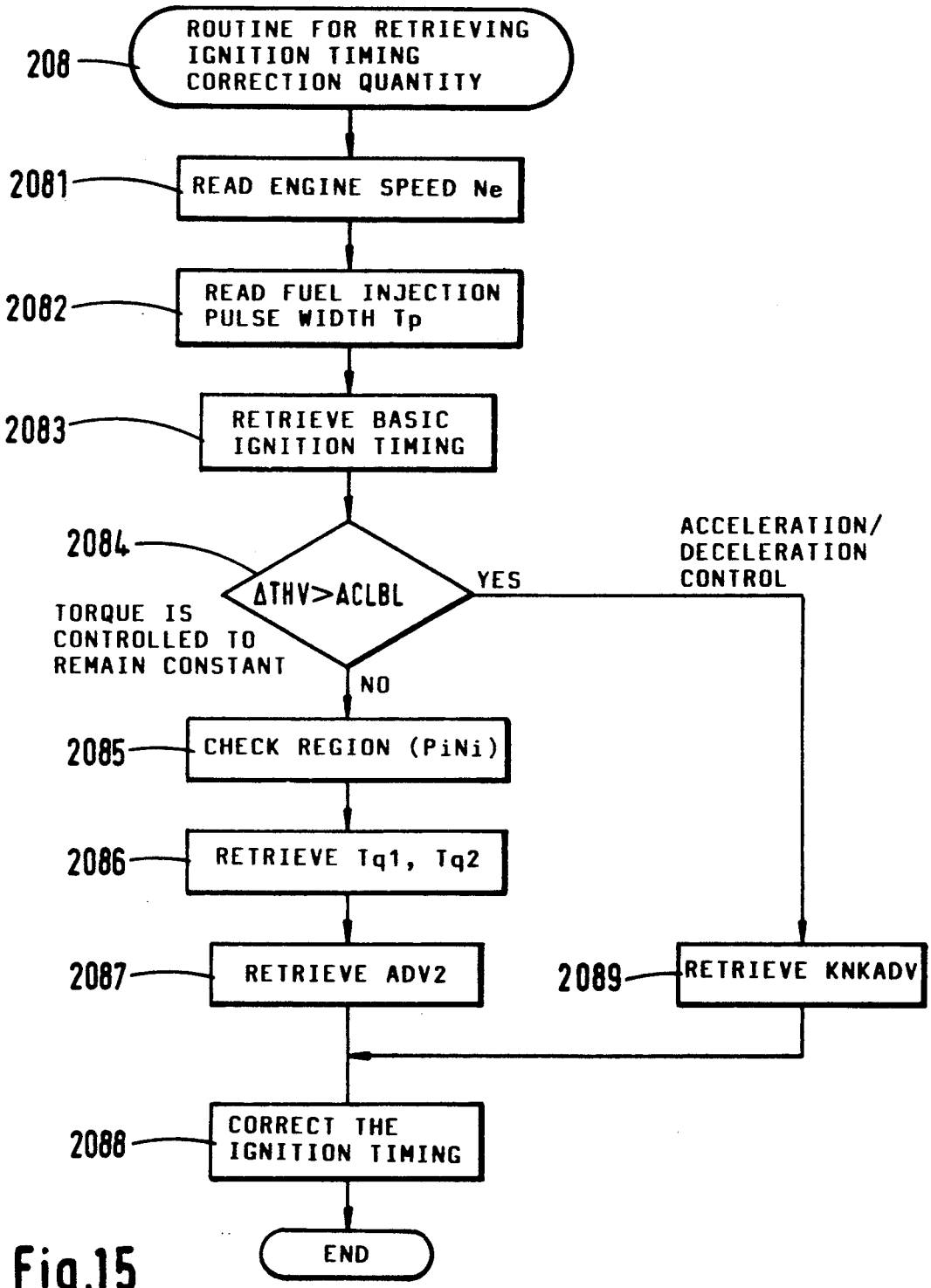

Next, FIGS. 13 to 15 show flowcharts for executing the above-mentioned operations using a microcomputer.

First, the operation shown by the flowchart of FIG. 13 is to know which cylinder corresponds to the injection pulse width and to hold the above injection pulse width in the RAM 104. Here, with reference to the waveform diagram of FIG. 6, the injector drive pulse generation interrupt corresponds to the first cylinder as also shown in FIG. 6(*d*). Therefore, step 400 renders a decision "Yes", and the program execution proceeds to step 406 where a fuel injection width with which the fuel is actually injected by the injector is set to INJ1 in the RAM, to end the execution of the program. Next, when the injection pulse width corresponds to the second cylinder, the program proceeds to step 407 according to the decision at step 401. Thus, the actual fuel injection widths corresponding to the respective cylinders are set to INJ1-INJ6 in the RAM in the manner as described above.

In the flowchart shown in FIG. 14, the sequence is started by interrupt signals $Into_{0-11}$ that are generated at the start and the end of the suction stroke of each of the cylinders, and calculates the deviation of the A/F ratio of each of the cylinders to correct the ignition timing. Firstly at step 200, it is judged which cylinder finishes the suction stroke based on the numbers (0 to 11) of the interrupt signals Int. This judgement can be done easily based on the number of Int as will be obvious from the aforementioned Table 1. In the case of, for example, the first cylinder, it must be checked whether the number of Int is "9" or not. When the step 200 renders the decision "No", the program execution proceeds to step 206 where the number n (n is an integer starting from 1) is increased by 1 and is then compared at step 207 with a predetermined number. In the case of the above six-cylinder internal combustion engine, the program ends if the number is greater than 6. Therefore, the number is set to "7" here.

Next, when step 200 renders the decision "Yes" (which corresponds to the end of suction stroke of the first cylinder), the program execution proceeds to step 201 where an average number of revolutions AVRPM in the suction stroke of the corresponding cylinder is found. At the next step 202, an average amount of intaken air $AFMQ_a$ is determined. The postscript n shown is an integer number which starts with 1 and ends with 6, and which corresponds to the cylinder number. At step 203, a desired fuel injection amount TRGTP which is necessary for obtaining a desired air-fuel ratio A/F1 (=14.7) is calculated based on the above values AVRPM and $AFMQ_a$. At step 204, an actual air-fuel ratio A/F2 in the cylinder in compliance with the following equation from a ratio relative to the fuel injection amount INJn that has been injected already (that has been set to INJ1-INJ6 of the RAM 104, $$A/F2 = \frac{INJn}{TRGTP} \times A/F1$$

Then, at step 205, a deviation, i.e., an A/F ratio of the practical air-fuel ratio in the cylinder is calculated in compliance with the equation, $$\Delta A/F = A/F2 - A/F1$$

Finally, at step 208, the ignition timing correction quantity is retrieved based on the thus found ΔA/F to end the program.

The flowchart of FIG. 15 illustrates in detail the routine 208 for retrieving the ignition timing correction quantity. In the routine 208 for retrieving the ignition timing correction quantity, first, at step 2081, the number Ne of revolutions of the internal combustion engine is read; at step 2082, a fuel injection pulse width Tp that is ordinarily calculated is read; and at step 2083, the basic ignition timing is retrieved based on these values Ne and Tp. This retrieval is carried out using the map shown in FIG. 7.

Thereafter, at step 2084, whether the amount of change THV in the rotational angle $\theta$ of the throttle valve 5 (see FIG. 1) is greater than a predetermined value ACLBL or not is determined. That is, when ΔTHV > ACLBL is not satisfied ("No"), a decision is so made that it is in steady operation, and the program proceeds to a step of controlling the torque to be constant. That is, at step 2085, the region ($P_iN_i$) in which the internal combustion engine is now being operated is retrieved from the map shown in FIG. 8 by using the number Ne of revolutions found at step 2081 and the fuel injection pulse width Tp found at step 2082. The flow then proceeds to step 2086 where the increment ΔTq of torque is calculated from the relationship (FIG. 11(*a*)) stored in the retrieved region $P_iN_i$. Thereafter, at step 2087, the ignition timing correction quantity ΔADV (FIG. 11(*b*)) is retrieved using ΔTq found above, and at step 2088, the ignition timing is determined by adding or subtracting the ignition timing correction quantity ΔADV to or from the basic ignition timing. On the other hand, in the case of acceleration or deceleration in which the step 2084 renders a decision "Yes", that is where ΔTHV > ACLBL is satisfied, the program proceeds to step 2089 where the ignition timing correction quantity KNKADV is calculated from the graph shown in FIG. 12. The program execution then proceeds to step 2088 to correct the ignition timing and to end the program.

Figures 16A, 16B, 16C:
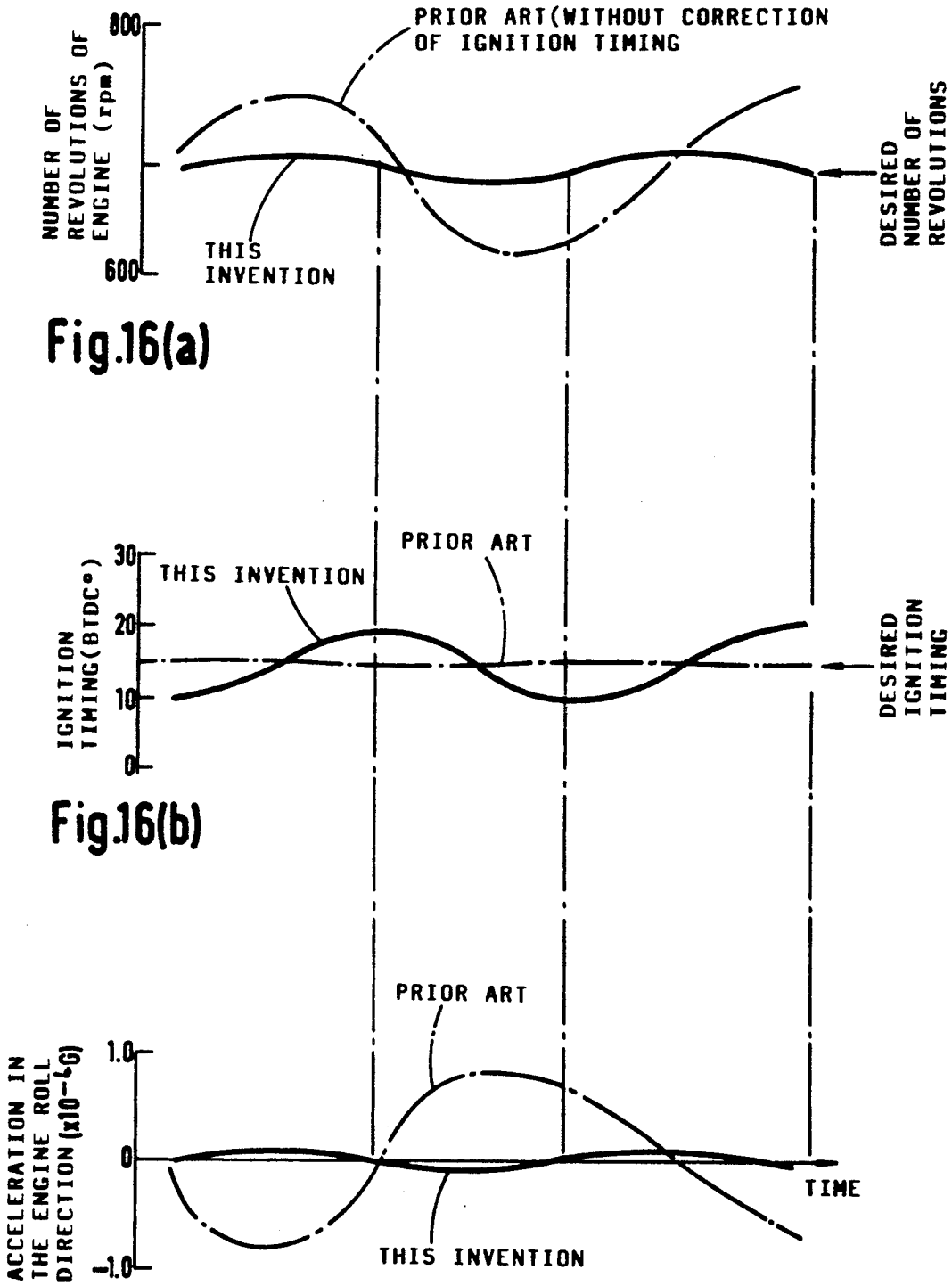
FIGS. 16(*a*) to 16(*c*) show graphs of actual measurements for demonstrating the effects that are obtained in practice by employing the present invention.

Finally, FIGS. 16(*a*) to 16(*c*) illustrate the effects obtained when the torque is controlled by employing the operation control method in accordance with the present invention. It will be obvious that changes in the number of revolutions of the engine (FIG. 16(*a*)) and in the acceleration causing vibration of the internal combustion engine in the roll direction (FIG. 16(*c*)) are drastically decreased compared with those of the conventional art, FIG. 16(*b*) showing the comparative change in ignition timing before top dead center (BTDC°).

By using the present method of controlling operation of an internal combustion engine and the electronic control device therefor of the present invention as will be understood from the above description, very good technical effects are exhibited such as realizing an internal combustion engine capable of producing smooth output with little change in the produced torque by appropriately adjusting the ignition timing to minimize the change in the torque even when the A/F ratio in each of the cylinders of the internal combustion engine deviates from the optimum value (target A/F).

It is to be understood that the invention has been described with reference to exemplary embodiments, and modifications may be made without departing from the spirit and scope of the invention as defined in the appended claims.

We claim:

1. A method of controlling the operation of an internal combustion engine, including the steps of determining both the required amount of fuel to be fed to a cylinder in dependence upon the number of revolutions of the engine and the amount of intake air that is received, said determination being made before the fuel injection valve is opened, detecting the actual amount of intake air that is sucked into said cylinder of the engine after the fuel injection valve is opened and based thereupon controlling the engine ignition timing for said cylinder.

2. A method of controlling the operation of a multi-cylinder internal combustion engine including the steps of determining the required amount of fuel to be fed to each of the cylinders based at least upon (a) the number of revolutions of the internal combustion engine and (b) said determination being made before a fuel injection valve is opened, controlling said fuel injection valve to inject fuel to said engine in dependence upon said required amount of fuel that is determined, said method being characterized by detecting the actual amount of intake air in the suction stroke of cylinder of concern after said fuel injection valve is opened, and controlling the ignition timing for said cylinder of concern based upon the actual amount of intake air.

3. A method of controlling the operation of an internal combustion engine according to claim 2, wherein a basic ignition timing is initially determined based upon the number of engine revolutions and the amount of intake air detected before the opening of said fuel injection valve simultaneously with the determination of said required amount of fuel, and said basic ignition timing (ADV1) is corrected based upon said actual amount of intake air after the opening of said fuel injection valve and in said suction stroke of said cylinder of concern in order to determine said ignition timing.

4. A method of controlling the operation of an internal combustion engine according to claim 3, wherein said basic ignition timing is corrected based upon the difference between the amount of intake air used for determining the required amount of fuel before the opening of said fuel injection valve and the actual amount of air intake after the opening of said fuel injection valve.

5. A method of controlling the operation of an internal combustion engine as claimed in claim 2, further including the steps of determining the engine water temperature, determining a second ignition angle in dependence thereon, and modifying the first mentioned ignition timing by said second ignition angle.

6. A method of controlling the operation of an internal combustion engine as claimed in claim 2 wherein the actual amount of intake air is determined by measuring the intake air quantity at a plurality of intervals during the suction stroke and averaging the intake air quantity during said suction stroke.

7. A method of controlling the operation of an internal combustion engine as claimed in claim 2 wherein during transient engine conditions the actual air-fuel ratio after the opening of said fuel injection valve is measured and the difference from a desired air-fuel ratio is determined, said difference being used to obtain an ignition timing correction quantity.

8. An electronic fuel control apparatus for an internal combustion engine comprising means for determining the required amount of fuel to be fed to a cylinder in dependence upon the number of revolutions of the engine before a fuel injection valve is opened in a cycle of concern, means for determining the amount of intake air that is received before said fuel injection valve is opened in said cycle of concern, means for detecting the actual amount of intake air that is sucked into said cylinder of the engine after the fuel injection valve is opened in said cycle of concern to produce a signal, and means using said signal for controlling the engine ignition timing for said cylinder in said cycle of concern.

9. An electronic control apparatus for a multi-cylinder internal combustion engine comprising detecting means for detecting various data that represent operation conditions of the internal combustion engine, control circuit means for receiving a detection signal from said detecting means and for outputting at least a fuel feed control signal and an ignition timing control signal a fuel injection valve for injecting fuel in dependence upon said fuel feed control output from said control circuit means and an ignition device for generating a high voltage for ignition in dependence upon the ignition timing control output from said control circuit means; characterized in that said control circuit means includes means for determining the required amount of fuel to be fed to a cylinder of concern based upon the number of revolutions of the internal combustion engine and the amount of intake air received before the opening of said fuel injection valve, and further includes means for detecting the actual amount of intake air in the suction stroke of the cylinder of concern after the opening of said fuel injection valve so as to produce a control signal, and means for using said control signal to modify the ignition timing of said ignition device for said cylinder of concern.

10. An electronic control apparatus for an internal combustion engine according to claim 9, wherein said control circuit means corrects said basic ignition timing based upon the difference between the amount of intake air used for determining the required amount of fuel before the opening of said fuel injection valve and the actual amount of air intake after the opening of said fuel injection valve.

11. An electronic control apparatus for an internal combustion engine according to claim 10, wherein said control circuit means determines a basic ignition timing based upon the number of engine revolutions and the amount of intake air received before the opening of said fuel injection valve simultaneously with the determination of said actual amount of intake air and corrects said basic ignition timing based upon said actual amount of intake air after the opening of said fuel injection valve so as to determine said ignition timing.

12. An electronic control apparatus for an internal combustion engine as claimed in claim 9 wherein there are provided engine water temperature sensor means for sensing water temperature of the engine, means for determining an ignition angle in dependence thereon, and means for varying said control signal in dependence upon said water temperature dependent ignition angle.

13. An electronic control apparatus for an internal combustion engine as claimed in claim 9 wherein the means for detecting the actual amount of intake air includes an air flow sensor, store means for measuring the intake air quantity from said air flow meter at a plurality of intervals of time during the suction stroke, and integrating means for averaging the intake air quantity held by said store means during the suction stroke.

14. An electronic control apparatus for an internal combustion engine as claimed in claim 10 wherein, during transient engine conditions, means are provided for measuring the actual air-fuel ratio after the opening of said injection valve, and said control means determines the difference from a desired air-fuel ratio, whereby said difference is used to obtain an ignition timing correction quantity.

* * * * *